United States Patent [19]

Grubb

[11] Patent Number: 4,502,733

[45] Date of Patent: Mar. 5, 1985

[54] OIL MINING CONFIGURATION

[75] Inventor: James R. Grubb, Golden, Colo.

[73] Assignee: Tetra Systems, Inc., Golden, Colo.

[21] Appl. No.: 502,089

[22] Filed: Jun. 8, 1983

[51] Int. Cl.[3] ..... E21C 41/00

[52] U.S. Cl. ..... 299/2; 299/19; 166/245

[58] Field of Search ..... 299/2, 19; 166/245, 166/369

[56] References Cited

U.S. PATENT DOCUMENTS

| | | | |
|---|---|---|---|
| 1,224,613 | 5/1917 | DeRoode | 299/2 |
| 1,225,784 | 5/1917 | DeRoode | 299/8 |
| 1,229,418 | 6/1917 | DeRoode | 299/19 |
| 1,520,737 | 12/1924 | Wright | 299/2 |
| 3,437,378 | 2/1967 | Smith | 299/2 |
| 4,009,649 | 3/1977 | Thimurs | 299/19 |
| 4,099,783 | 6/1978 | Verty | 299/2 |
| 4,157,650 | 3/1981 | Allen | 299/2 |
| 4,165,903 | 8/1979 | Cobbs | 299/2 |
| 4,238,088 | 8/1981 | Tabakov et al. | 299/2 |

*Primary Examiner*—Stephen J. Novosad
*Assistant Examiner*—Mark J. DelSignore
*Attorney, Agent, or Firm*—W. Scott Carson

[57] ABSTRACT

An oil mining configuration primarily intended for use as a production drift for the recovery of petroleum from an overlying, oil bearing formation by gravity drainage. The configuration is in the general shape of a lollipop when viewed from above and has a stem portion and an annular head portion. The stem portion extends from a first location adjacent a main drift to a second location. The annular head portion extends from the second location about a vertical axis to a third location and on around to the second location to complete the lollipop shape. Production wells are drilled upwardly from the lollipop drift and the produced oil as well as gas and water are collected in tanks in the head portion and pumped up a service well extending from the head portion to the surface. Two methods of forming the lollipop drift are disclosed as are details of its design and operation including air flow and accidental spill recovery. In all embodiments, each lollipop is preferably a separate and independent production unit which can be easily isolated from the main drift and other lollipops should a problem (e.g., gas leak) occur in it.

65 Claims, 12 Drawing Figures

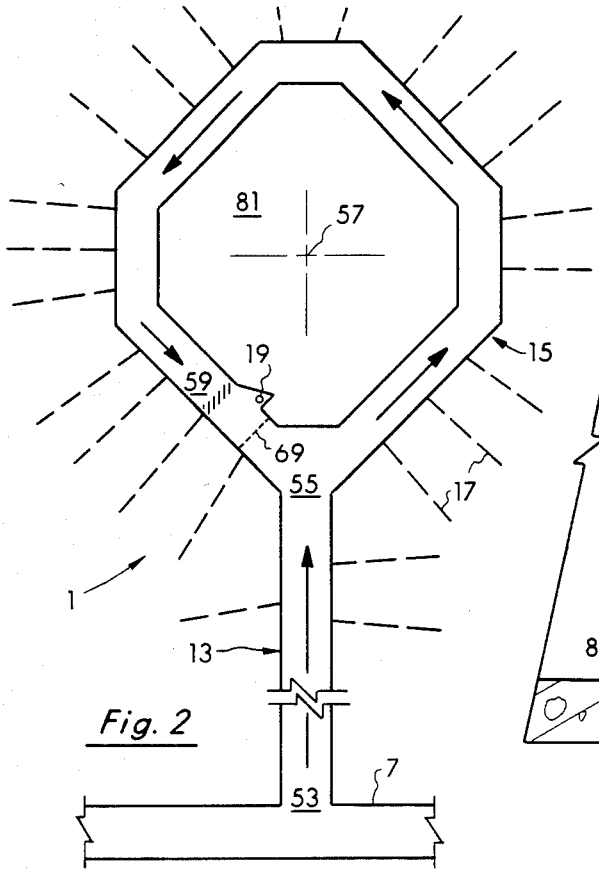
Fig. 2
Fig. 5
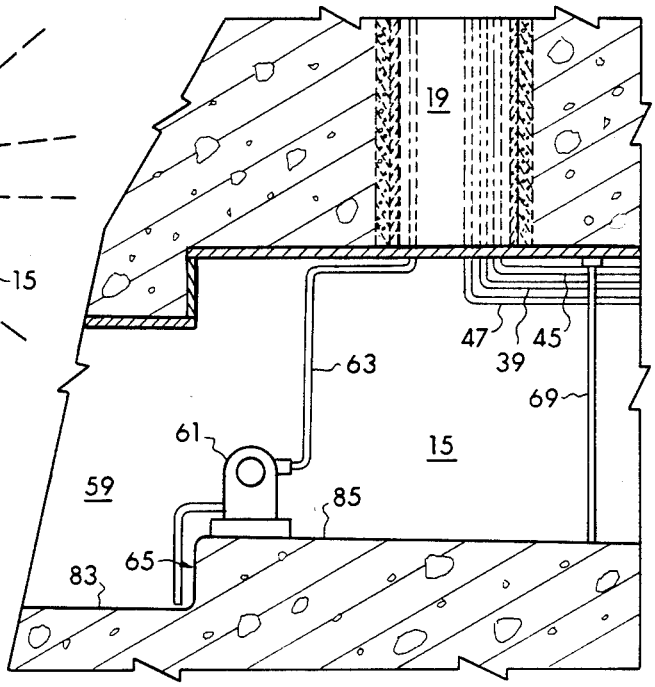
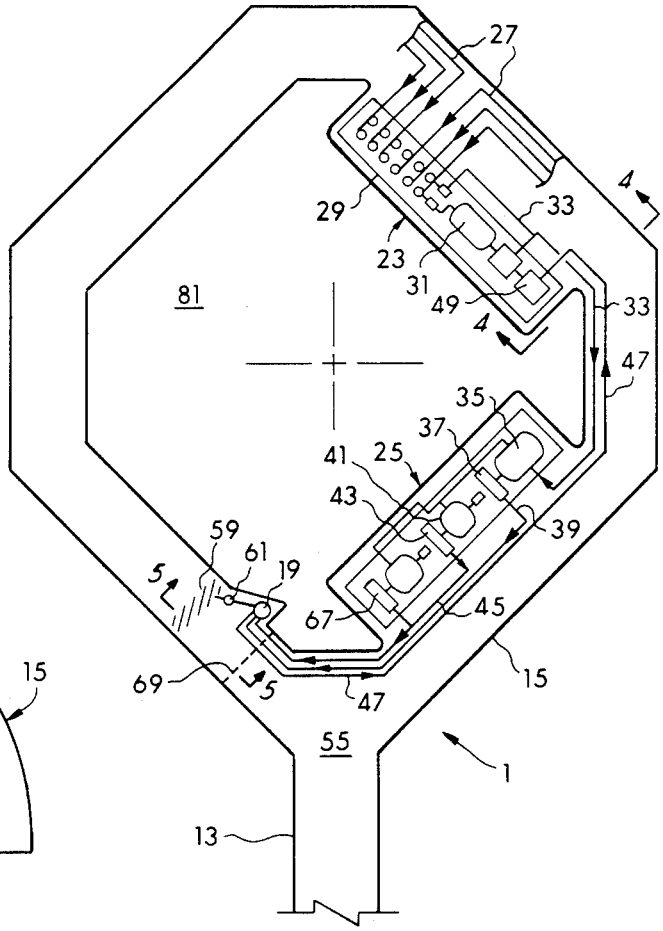
Fig. 3
Fig. 4
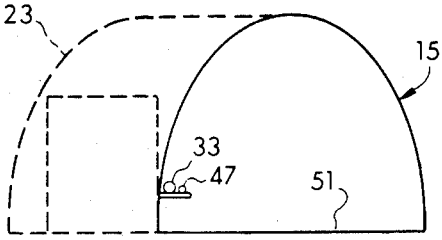

OIL MINING CONFIGURATION

FIELD OF THE INVENTION

This invention relates to the field of oil mining and more particularly to a mining configuration primarily intended for use in the recovery of oil from proven reservoirs by gravity drainage techniques.

BACKGROUND OF THE INVENTION

Oil mining is an old concept dating back thousands of years. In contrast to more commonly known surface techniques for recovering oil in which wells are drilled downwardly to the oil bearing formation and the oil is then pumped up the well bore to the surface, the simplest oil mining technique (i.e., gravity drainage) involves mining tunnels under the oil bearing formation and then drilling completion holes upwardly into the oil reservoir. The oil then drains downwardly by gravity where it is collected and eventually pumped to the surface.

The term "oil mining" actually encompasses a spectrum of processes designed to free petroleum from conventionally depleted fields and from fields not otherwise workable by conventional techniques. In addition to gravity drainage, two other basic oil mining methods include extractive and capillary interchange. In extractive mining, the oil bearing rock is removed and processed in underground or surface facilities. With this method, essentially all of the in-place petroleum is recovered. However, because of high costs, it is primarily only feasible for use in reservoirs with thick and rich petroleum seams and with little or no overburden and in host environments (e.g., unconsolidated sand) where minimal processing will easily remove the petroleum. In the capillary interchange or "flip-flop" method, petroleum is recovered from shallow deposits of heavy oil and tar sand by first removing the overburden or forming a cavern above the deposit. A containment is then constructed and the partially exposed oil or tar sand deposit is flooded with a hot, high-density, saline solution. The heat from the water reduces the viscosity of the oil and the difference in specific gravities of the saline solution and petroleum cause the two to exchange positions or flip-flop. The oil migrates upwardly and is recovered from the saline solution. With this method, laboratory tests indicate that recovery will actually be effective over an area greater than the exposed portion of the deposit. As compared to the extractive mining process, none of the oil bearing sand or rock needs to be moved in the capillary interchange technique; however, as a practical matter, capillary interchange techniques are generally limited to oil recovery from heavy oil deposits within a few hundred feet of the surface.

It has been estimated that the total oil resources of the United States originally in the ground was about 450 billion barrels of which 120 have already been recovered through conventional primary and secondary techniques. Of the remaining 330 billion barrels, it is believed that 30 can still be recovered by such conventional techniques leaving 300 billion barrels still within the ground. Using oil mining techniques, it is further estimated that two-thirds of this remaining oil or 200 billion barrels could be produced which is more than all the oil that has been recovered in the United States since the first well was drilled in 1859 by Colonel Drake.

Of the three oil mining methods, gravity drainage is the simplest and potentially most effective process for recovering petroleum from conventionally depleted fields. Although general gravity drainage techniques have been used for thousands of years, little if any significant advances have been made in such fundamental areas as mine configuration (e.g., tunnel or drift layout and design) and logging techniques specially adapted to meet the needs and requirements of oil mining by gravity drainage. Rather, the trend has been to try to use conventional mining configurations and logging techniques yet such teachings are often unsuited or at cross-purposes to oil mining. For example, literally all logging techniques use a flexible cable to lower and raise a logging tool within the well hole and such techniques are for the most part totally unsuited for use in upwardly extending holes. As another example, conventional mining configurations generally have as their primary purpose to remove as much of the ore or rock as possible while leaving as little in place for support as is practical. In contrast, a mining configuration for oil recovery by gravity drainage would preferably remove as little rock as possible with the minimum amount of linear tunnel feet for developmental speed and efficiency while creating as much drilling surface area and room as possible for upward drilling, completion, and oil production facilities.

It was with the above in mind that the mine configuration of the present invention was developed. With it, oil production from conventionally depleted fields by gravity drainage can be implemented effectively and efficiently.

SUMMARY OF THE INVENTION

This invention involves a mine configuration primarily intended for use as a production drift for the recovery of petroleum from an overlying, oil bearing formation by gravity drainage. The configuration is in the general shape of a lollipop when viewed from above and has a stem portion and an annular head portion. The stem portion extends from a first location adjacent a main drift to a second location. The annular head portion extends from the second location about a vertical axis to a third location and on around to the second location to complete the lollipop shape. Production wells are drilled upwardly from the lollipop drift and the produced oil as well as gas and water are collected in tanks in the head portion and pumped up a service well extending from the head portion to the surface.

The lollipop configuration removes as little rock as possible with a minimum amount of linear tunnel feet for developmental speed and efficiency while creating ample surface area and room for upward drilling, completion, and oil production facilities. In one method of forming the lollipop configuration, a tunneling machine is advanced always in a forward direction from a first location to a second location to form the lollipop stem and then from the second location about a vertical axis to a third location and on around to the second location to form the lollipop head. The tunneling machine is then further advanced in a forward direction from the second location back along the stem to the first location wherein the lollipop is formed without having to back up the tunneling machine. In the preferred method of forming the lollipop configuration, the tunneling machine is advanced from the first location to the second location to form the stem and then advanced in a first radial direction about the vertical axis to the third location to form a small part of the annular head portion. The tunneling machine is then moved backwards to the second location and next advanced as in the first method about the vertical axis and back out the stem portion. The first formed part of the head portion serves as a convenient storage area for the roof bolting machine and convenient turnaround and passing space for the muck removers as the tunneling machine is forming the main part of the head portion. Additionally, it serves to locate the service well so that the annular head portion can be properly oriented relative to it. In both methods, the floor of the stem and head portions preferably slopes downwardly from the first to the second location and on about the head portion to the third location at about a 1% slope so that any free liquid (e.g., from a leak or spill) drains to the third location. Also, the annular head portion from the third location back around toward the second location in both methods is inclined upwardly and preferably includes a step-up so that the third location is the lowest area in the lollipop. A sump pump is the provided to pump any free liquid collected at the third location up the service well to the surface.

The lollipop configuration of the present invention also includes means for confining the air flow through the lollipop to one direction up the stem, substantially about the head portion, and up the service well. In this manner, fresh air is maintained in the lollipop and perhaps more importantly, any oil fumes are drawn out rather than permeating the production and main drifts creating a safety hazard. In another embodiment, a plurality of lollipop configurations are formed off of a main drift which is in the shape of an 8 with the stems of the lollipops extending outwardly and inwardly of the loops of the 8. In this embodiment as in the other embodiments, each lollipop is a separate and independent production unit which can be easily isolated from the main drift and other lollipops should a problem (e.g., gas leak) occur in it.

BRIEF DESCRIPTION OF THE DRAWINGS

FIG. 2 is a view taken along line 2—2 of FIG. 1 showing the overall lollipop shape of a production drift as it extends from the main drift.

FIG. 3 is an enlarged view of the annular head portion of the lollipop illustrating the general placement of the oil production facilities within the head portion.

FIG. 4 is a cross-sectional view of the annular head portion of the lollipop taken along line 4—4 of FIG. 3 and illustrating the overall profile of the tunnel and an equipment bay.

FIG. 5 is a view taken along 5—5 of FIG. 3 illustrating the annular head portion of the lollipop in the area of the sump.

FIG. 10 shows an additional step in which the tunneling machine is driven first clockwise at the top of the stem to form a part of the annular head portion, then moved backward to the top of the stem, and finally advanced from the top of the stem as in FIGS. 7–9. By adding the additional step of FIG. 10 to the lollipop forming process, a convenient storage area for the roof bolting machine is provided as well as a convenient turnaround and passing space for the muck removers as the tunneling machine is forming the main part of the head portion. Also, the additional step is used to locate the service well whereupon the annular head portion can then be properly oriented relative to it.

DETAILED DESCRIPTION OF THE PREFERRED EMBODIMENTS

Figure 1:
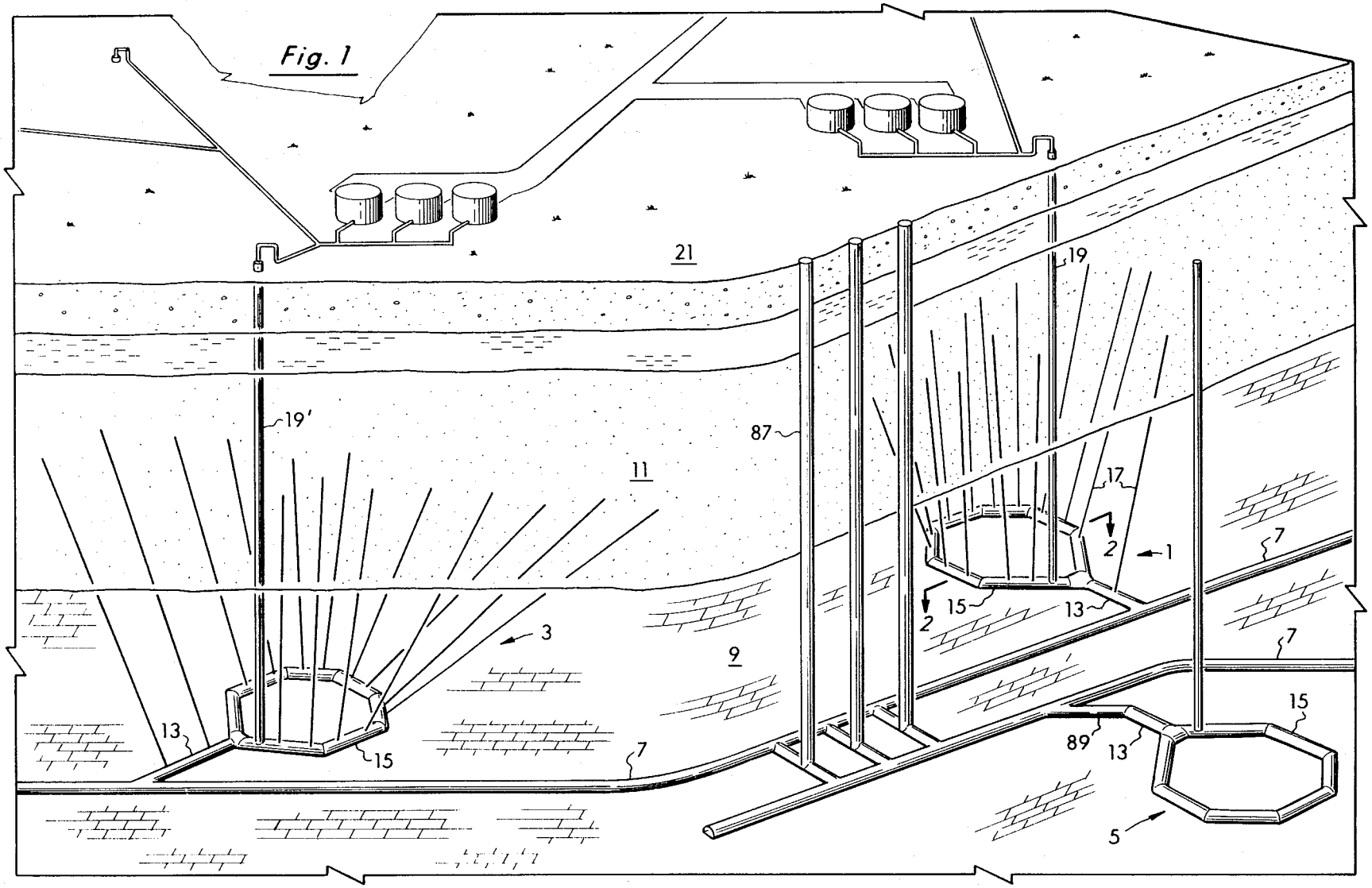
FIG. 1 is a view of an oil mining operation by gravity drainage in accordance with the present invention illustrating the use of the lollipop-shaped production drifts to recover petroleum from an overlying, oil bearing formation.

FIG. 1 illustrates an oil mining operation by gravity drainage in accordance with the present invention. In this operation, a plurality of lollipop-shaped production drifts 1, 3, and 5 are drilled from the main drift 7 which preferably extends in the subsurface stratum 9 beneath the oil bearing formation 11. Each of the lollipops as typified by the lollipop drift 1 of FIGS. 1 and 2 has a stem portion 13 and an annular head portion 15 with production wells 17 extending upwardly into the overlying, oil bearing formation 11. Additionally, each lollipop has a service well 19 extending substantially vertically between the surface 21 and the annular head portion 15 of the lollipop 1.

Figure 6:
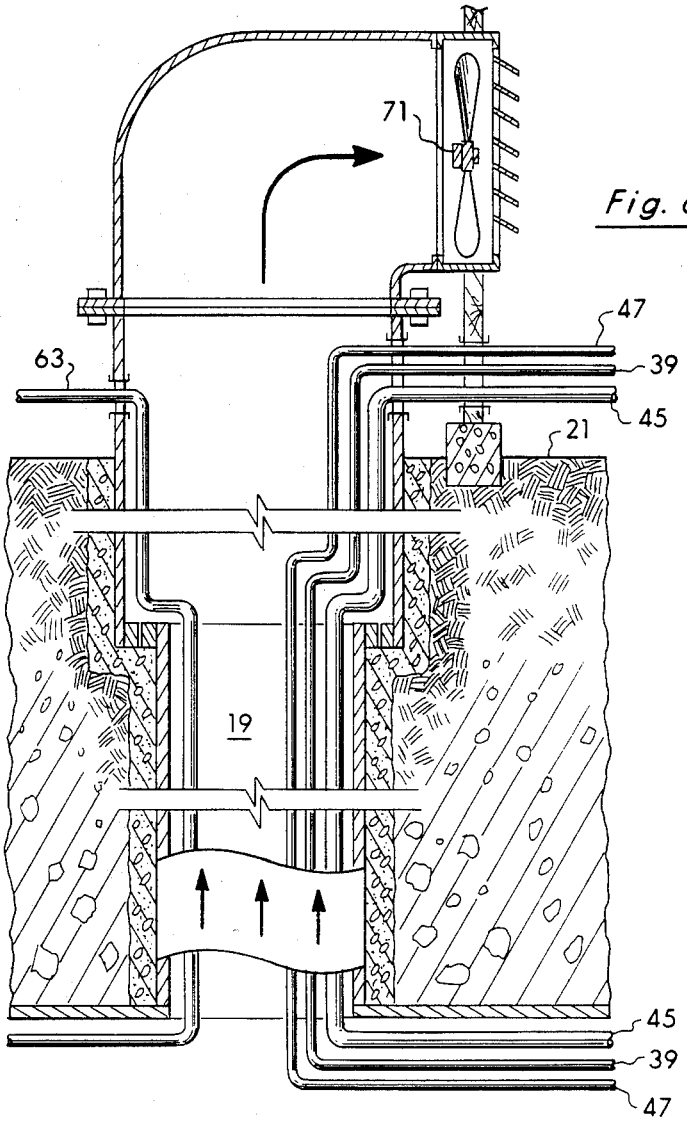
FIG. 6 is a cross-sectional view of the service well which extends between the surface and the annular head portion of the lollipop and through which passes the produced oil and gas, ventilation air, recovered water, and compressed air to run the production facilities in the respective lollipop.

As best seen in FIG. 3, each lollipop such as 1 is a self contained production unit separate and apart from the other lollipops 3 and 5 and the main drift 7. In this manner, any problems that may occur in one particular lollipop (e.g., spills, fires, gas leaks, well blowouts) can be essentially contained in that lollipop by barricading off the stem 13 from the main drift 7. In this manner, such problems can be isolated so as not to affect the operation of the other lollipop units or passage along the main drift 7. Referring again to FIG. 3, each annular head portion 15 has equipment bays such as 23 and 25 to receive production facilities which are preferably mounted on skids. In the preferred mode of operation, petroleum from the production wells 17 drains by gravity downwardly from the oil bearing formation 11 into pipes 27 in the head portion 15 where it is collected in tanks at 29. A test separator such as 31 can be provided which selectively monitors the production from each of the incoming pipes 27; however, in normal operation, the collected oil, gas, and water bypasses the test separator 31 through line 33 on its way to the production separator 35. Separated gas is then collected and pumped from 37 through line 39 to the service well 19 and up the service well 19 (see FIG. 6) to the surface 21. Similarly, the separated oil and water at 35 passes into the tank 41 and is pumped from 43 through line 45 to and up the service well 19 (see FIG. 6) to the surface 21. The line 47 in FIGS. 3 and 6 is a compressed air line leading from the surface 21 down the service well 19 and around the head portion 15 to the storage tank 49. In the preferred mode of operation, all of the pumps, separators, and other equipment are run by compressed air for safety; however, other power and control lines can run between the surface 21 and the head portion 15 through the service well 19 as desired.

Although the cross section of the annular head portion 15 may vary, it is anticipated as shown in FIG. 4 that it will be of a general horseshoe shape with a height of about 10 feet from the floor 51 and a width at the floor 51 of about 12 feet. The equipment bay 23 as shown in dotted lines in FIG. 4 is anticipated to be about 7 feet deep creating a 6×6 foot space to receive the production equipment.

In the preferred embodiment, the stem portion 13 as shown in FIG. 2 extends from a first location 53 to a second location 55 with its floor inclined substantially continuously downwardly at about a one percent slope. Additionally, the annular head portion 15 of the lollipop 1 from the second location 55 extends about the vertical axis 57 in a counterclockwise direction to a third location 59 at a substantially continuously downward inclination of about one percent slope. In this manner, any free liquid as from spills or leaks in the annular head portion 15 between the second and third locations 55 and 59 will flow around the head portion 15 in a counterclockwise direction to the third location 59 where a sump pump 61 (see FIG. 5) can then pump it up the service well 19 through line 63. Further, in the preferred embodiment, any free liquid in the stem portion 13 of the lollipop will also drain from the first location 53 to the second location 55 and on around the head portion 15 in a counterclockwise direction to the third location 59. The inclination is not only important to direct the flow of any free liquid but also to provide considerable space to hold any such free liquid in the event any spill or leak occurs. For example, it is anticipated that a typical length of a stem portion 13 will be about 500 feet and the annular length of the head portion 15 will be about 400 feet with the substantially vertical step up 65 in FIG. 5 then being about four feet. If desired, the backup pump at 67 (see FIG. 3) in bay 25 can be used in place of or in conjunction with the sump pump 61 to pump any free liquid from the third location 59 up the service well 19.

As best seen in FIGS. 2, 3, and 5, a brattice member 69 is provided between the second location 55 and the third location 59 in a clockwise direction about the vertical axis 57. The brattice stopping member 69 (e.g., canvas curtain) substantially prevents any airflow across it. Consequently, with the surface exhaust fan 71 on (see FIG. 6), airflow through the lollipop 1 is confined to one direction up the stem portion 13 from 53 to 55, about the head portion 15 from 55 counterclockwise to 59, and up the service well 19 to the surface 21. In this manner, fresh air is maintained in the lollipop but more importantly, any oil fumes are drawn out rather than being allowed to permeate the lollipop 1 and main drift 7 creating a safety hazard. Further, the lollipop shape allows the flow of air to sweep nearly every part of the lollipop 1 leaving a minimum of dead air spaces where potentially dangerous amounts of gas (e.g., methane) might collect.

Figure 7:
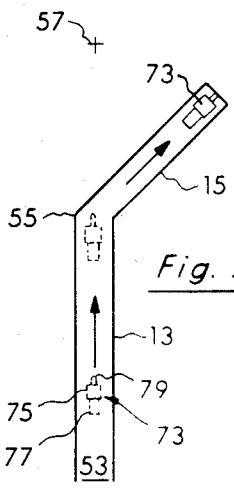
FIGS. 7–9 illustrate one method of forming the lollipop shape. In this method, the tunneling machine can be advanced up the stem portion, around the annular head portion, and back out the stem portion always in a forward direction without the need to turn it around or back it up.
Figure 8:
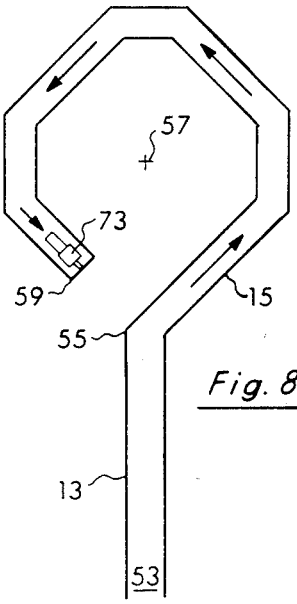
Figure 9:
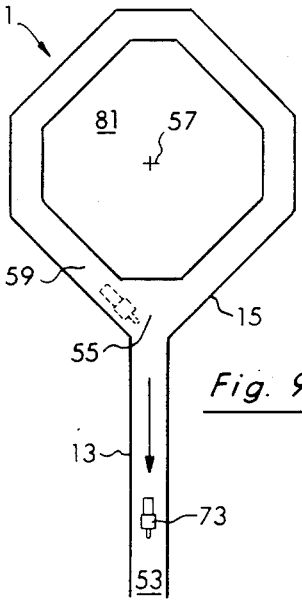

In one method of forming the lollipop shape 1 as illustrated in FIGS. 7–9, the tunneling machine 73 is advanced up the stem portion 13, around the annular head 15, and back out the stem portion 13 always in a forward direction without the need to turn it around or back it up. More specifically, the tunneling machine 73 has forward and rear ends 75 and 77 with an excavating means 79 on the front end 75. In operation, the tunneling machine 73 is advanced in the subsurface stratum 9 from the first location 53 to the second location 55 in a forward direction with the front end 75 leading the rear end 77 and with the excavating means 79 operating to form the stem portion 13 of the lollipop 1. The tunneling machine 73 is then advanced still in the forward direction from the second location 55 in a counterclockwise direction about the vertical axis 57 to the third location 59 again with the excavating means 79 operating to form nearly all of the annular head portion 15 of the lollipop 1. From the third location 59 in FIG. 8, the tunneling machine is further advanced in the forward direction about the vertical axis 57 back to the second location 55 with the excavating means 79 operating to complete the annular head portion 15 of the lollipop 1. The tunneling machine 73 is then returned to the main drift 7 by advancing it in a forward direction from the second location 55 along the stem portion 13 to the first location 53 wherein the lollipop-shaped production drift 1 is formed by the tunneling machine 73 without the need to turn it around or back it up. The advantages of operating the tunneling machine 73 in this fashion can be quite substantial in regard to time and cost savings. For example, a typical length of the stem portion 13 is anticipated to be about 500 feet and the annular length of the head portion 15 to be about 400 feet and it has been estimated that just to back the tunneling machine 73 about the vertical axis 57 from the third location 59 in a clockwise direction back to the second location 55 would take on the order of eight to ten hours. In specific regard to this method of forming the lollipop shape 1, it is fully anticipated that the tunneling machine 73 may well be moved over relatively small distances in a rearward direction (e.g., to service the cutting head) but on the scale of the lollipop, these rearward movements would be insignificant and the operation of the tunneling machine 73 for all practical purposes would be always in a forward direction.

Referring again to FIG. 8 and for the reasons discussed above, it is preferred that the tunneling machine 73 be advanced at a substantially continuous downward inclination of about one percent slope from location 53 to 55 and on about the axis 57 to the location 59. It is also preferred that the tunneling machine 73 be advanced from location 59 back toward the second location 55 at an upward inclination to ensure that the third location 59 is the lowest area in the annular head portion 15 of the lollipop 1. As also shown in FIGS. 7–9, the preferred method of forming the lollipop shape includes advancing the tunneling machine 73 about the vertical axis 57 in a series of substantially straight segments wherein the head portion 15 assumes a substantially polygonal shape when viewed from above. As best seen in FIG. 9, the stem portion 13 from the first to the second locations 53 and 55 extend substantially straight along an axis which substantially intersects the vertical axis 57. Also, the annular head portion 15 of the lollipop is preferably spaced from and extends substantially symmetrically about the vertical axis 57 to leave a substantial support pillar 81 of undisturbed material about the vertical axis 57 within the head portion 15.

Figure 10:
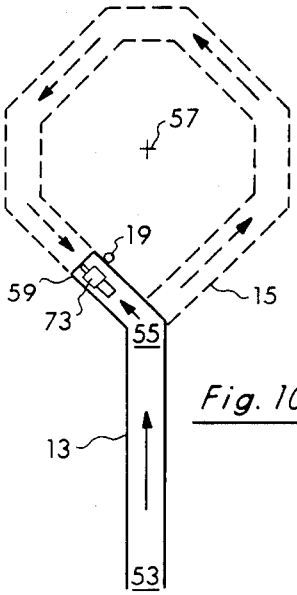
FIG. 10 when taken with FIGS. 7–9 illustrates the preferred method of forming the lollipop. As opposed to the method of FIG. 7–9 alone in which the tunneling machine is always driven in a forward direction.

FIG. 10 when taken with FIGS. 7–9 illustrates the preferred method of forming the lollipop 1. As opposed to the method of FIGS. 7–9 alone in which the tunneling machine 73 is always driven in a forward direction, FIG. 10 shows an additional step in which the tunneling machine 73 is driven first in a clockwise radial direction about the axis 57 at the top 55 of the stem portion 13 to form a part of the annular head portion 15. The tunneling machine 73 is then moved backward to the top 55 of the stem portion 13 and finally advanced from 55 as in FIGS. 7–9. By adding the additional step of FIG. 10 to the lollipop forming process, a convenient storage area for the roof bolting machine is provided as well as a convenient turnaround and passing space for the muck removers as the tunneling machine 73 is forming the main part of the head portion 15. Also, the additional step is used to locate the service well 19 whereupon a proper orientation can be realized to complete the forming of the annular head portion 15. The service well 19 in both methods of forming the lollipop shape 1 is preferably drilled first from the surface and then completed when the head portion 15 is finished. However, the service well 19 could also be drilled upwardly from the annular head portion 15 in certain circumstances; and, although it preferably extends upwardly from the annular head portion 15 adjacent the stem portion 13, it could extend upwardly from the stem portion 13 adjacent the head portion 15 if desired. Also, in the method of FIG. 10, the tunneling machine 73 is preferably advanced from 55 in the first radial direction (clockwise) to 59 at an upward inclination of about one percent slope. In this manner and as best seen in FIG. 5, the breakthrough when the tunneling machine 73 completes its counterclockwise advance around the vertical axis 57 to location 59 will create a step 65. To remove the tunneling machine 73, it can then be advanced with some temporary rubble placed at the step to form an upwardly inclined ramp. By advancing the tunneling machine 73 at an upward inclination in the method step shown in FIG. 10, the bottom 83 of the step 65 is still the lowest area in the head portion 15 and additionally the top 85 of the step 83 is the highest area in the head portion 15. Consequently, should a spill or leak occur, the part of the head portion 15 originally dug by the step shown in FIG. 10 will be the highest and dryest area and it is contemplated that the controls for the production equipment and service well 19 will preferably be located in this area. Alternately as in the method of FIGS. 7–9, the tunneling machine 73 could be advanced from third location 59 counterclockwise toward the second location 55 at a gradual upward inclination (destroying the step up 65) which would still ensure that 59 was the lowest area in the head portion 15. In doing so, it is noted that the upward incline from the third location need not necessarily extend all the way to the second location to ensure that the third location is where virtually all of the free liquid will drain and collect.

Figure 11:
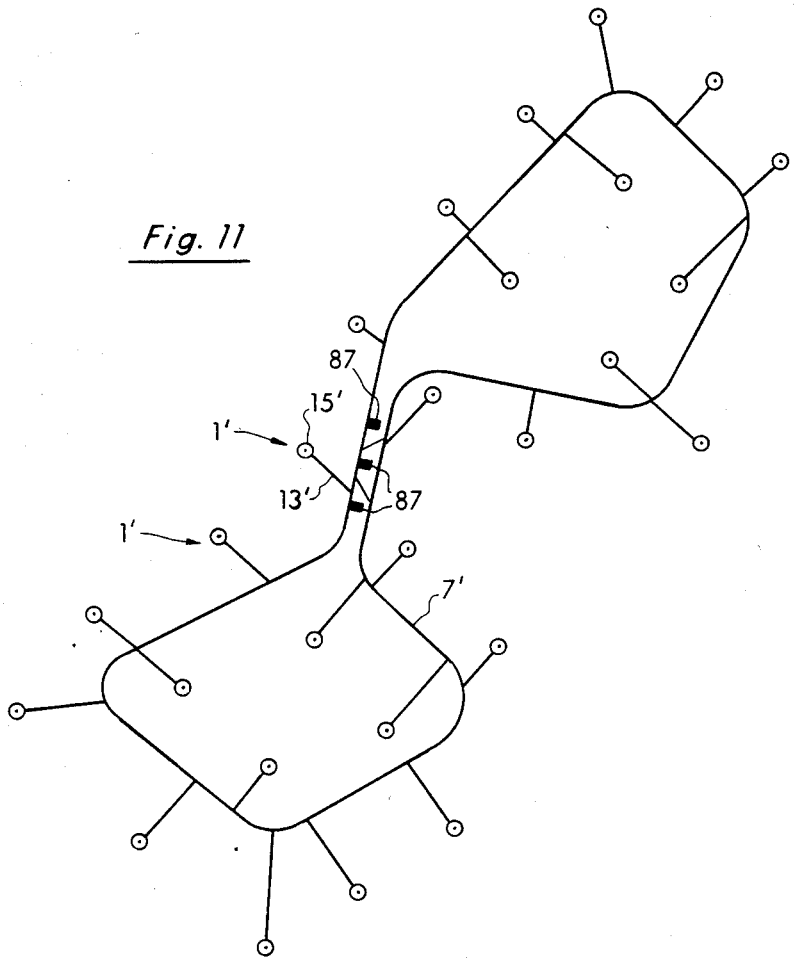
FIG. 11 is a top view of an overall mine configuration in which a plurality of lollipop production drifts are drilled inwardly and outwardly of a main drift which is in the general shape of an 8.
Figure 12:
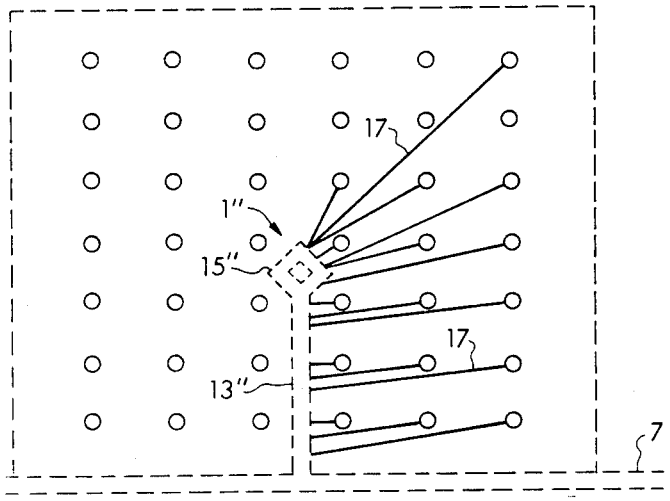
FIG. 12 is a spacial model of a pattern for drilling the production wells from each of the lollipops.

FIG. 11 is a top view of an overall mine configuration in which a plurality of lollipop drifts 1' are drilled inwardly and outwardly from the loops of a main drift 7' which is in the general shape of an 8. The 8-shape is preferably created by drilling shafts 87 downwardly from the surface 21 and then using one or more tunneling machines to dig the loops. When completed, the figure 8 of the main drift 7' offers an efficient traffic pattern as well as affording ample room for lollipop production drifts 1' to be dug inwardly and outwardly from the loops of the 8-shape. The lollipops 1' can be initially drilled off the main drift 7' at a variety of angles as illustrated in FIGS. 11 and 1. They can also include angled portions such as 89 in lollipop 5 of FIG. 1 between the main drift and the start of the stem portion which is preferably straight and substantially horizontal from the first location 53 to the second location 55. The head portions 15 can be drilled generally counterclockwise or clockwise with the service well on the left (19 in lollipop 1) or right (19' in lollipop 3) relative to the stem portion 13. The main drift is preferably drilled in stratum 9 beneath the oil bearing formation 11; however, it can be drilled in the subsurface stratum 11 if desired and conditions permit. Also, as illustrated in FIGS. 11 and 12, the annular shape of the head portion 15' and 15'' of the lollipops can vary but is preferably of the shape shown in FIGS. 2 and 3. As best seen in FIG. 12, the overall lollipop shape allows production wells 17 to be efficiently and effectively drilled upwardly into the oil bearing formation 11 as, for example, in the illustrated spacial pattern.

While several embodiments of the present inventions have been described in detail herein, it is understood that various changes and modifications can be made without departing from the scope of the invention.

I claim:

1. A method for operating a tunneling machine to form a mine configuration in a subsurface stratum, said configuration substantially resembling a lollipop when viewed from above and having a stem portion and a substantially annular head portion with said configuration being primarily intended for use as a production drift for the recovery of petroleum from an overlying, oil bearing formation by gravity drainage, said tunneling machine having front and rear ends with said front end having excavating means thereon and said tunneling machine moving in a forward direction when said front end leads said rear end and in a rearward direction when rear end leads said front end, said method including the steps of:

(a) advancing said tunneling machine in said subsurface stratum from a first location to a second location in said forward direction with said excavating means operating to form the stem portion of said lollipop, (b) advancing said tunneling machine in said forward direction from said second location substantially in a first radial direction about a vertical axis spaced from said second location to a third location with said excavating means operating to form a part of the annular head portion of said lollipop, (c) moving said tunneling machine in said rearward direction from said third location back to said second location along said part, (d) advancing said tunneling machine in said forward direction from said second location substantially about said vertical axis in a second radial direction substantially opposite to said first radial direction to said third location with said excavating means operating to form the remaining part of the annular head portion of said lollipop, (e) advancing said tunneling machine in said forward direction from said third location in said second radial direction to said second location, and (f) advancing said tunneling machine in said forward direction from said second location along said stem portion to said first location wherein a lollipop-shaped production drift is formed by said tunneling machine.

2. The method of claim 1 wherein step (d) includes the further limitation of advancing said tunneling machine from the second location to the third location at a substantially continuous, downward inclination whereby any free liquid in the remaining part of the annular head portion between the second and third locations will flow by gravity in said second radial direction to said third location and wherein step (e) includes the further limitation of advancing said tunneling machine from the third location toward said second location at an upward inclination whereby said third location is the lowest area in the annular head portion of the lollipop.

3. The method of claim 2 wherein said downward inclination of step (d) is about a one percent slope.

4. The method of claim 2 wherein step (a) includes the further limitation of advancing said tunneling machine from the first location to said second location at a substantially continuous, downward inclination.

5. The method of claim 4 wherein said downward inclination of steps (a) and (d) is about a one percent slope.

6. The method of claim 1 wherein step (d) includes the further limitation of advancing said tunneling machine about said vertical axis in a series of substantially straight segments whereby said annular head portion of said lollipop assumes a substantially polygonal shape when viewed from above.

7. The method of claim 1 wherein said annular head portion is spaced from and extends substantially symmetrically about said vertical axis to leave a support pillar of undisturbed material therewithin.

8. The method of claim 1 wherein said stem portion from said first location to said second location is substantially straight and substantially horizontal.

9. The method of claim 1 wherein said stem portion from said first location to said second location extends substantially straight along an axis substantially intersecting said vertical axis.

10. The method of claim 9 wherein said annular head portion is spaced from and extends substantially symmetrically about said vertical axis.

11. The method of claim 1 wherein step (b) includes the further limitation of advancing said tunneling machine in said first radial direction from said second location to said third location at a substantially continuous, upward inclination.

12. A method for operating a tunneling machine to form a mine configuration in a subsurface stratum, said configuration substantially resembling a lollipop when viewed from above and having a stem portion and a substantially annular head portion with said configuration being primarily intended for use as a production drift for the recovery of petroleum from an overlying, oil bearing formation by gravity drainage, said tunneling machine having front and rear ends with said front end having excavating means thereon and said tunneling machine moving in a forward direction when said front end leads said rear end, said method including the steps of:

(a) advancing said tunneling machine in said subsurface stratum from a first location to a second location in said forward direction with said excavating means operating to form the stem portion of said lollipop, (b) advancing said tunneling machine in said forward direction from said second location substantially about a vertical axis spaced from said second location to a third location with said excavating means operating to form a part of the annular head portion of said lollipop, (c) advancing said tunneling machine in said forward direction from said third location about said vertical axis to said second location with said excavating means operating to complete the annular head portion of said lollipop, and (d) advancing said tunneling machine in said forward direction from said second location along said stem portion to said first location wherein a lollipop-shaped production drift is formed by said tunneling machine with said tunneling machine always advancing in said forward direction.

13. The method of claim 12 wherein step (b) includes the further limitation of advancing said tunneling machine from the second location to the third location at a substantially continuous, downward inclination whereby any free liquid in said part of said annular head portion between the second and third locations will flow by gravity to said third location and wherein step (e) includes the further limitation of advancing said tunneling machine from the third location toward said second location at an upward inclination whereby said third location is the lowest area in the annular head portion of the lollipop.

14. The method of claim 13 wherein said downward inclination of step (b) is about a one percent slope.

15. The method of claim 13 wherein step (a) includes the further limitation of advancing said tunneling machine from the first location to said second location at a substantially continuous, downward inclination.

16. The method of claim 15 wherein said downward inclination of steps (a) and (b) is about a one percent slope.

17. The method of claim 12 wherein step (b) includes the further limitation of advancing said tunneling machine about said vertical axis in a series of substantially straight segments whereby said annular head portion of said lollipop assumes a substantially polygonal shape when viewed from above.

18. The method of claim 12 wherein said annular head portion is spaced from and extends substantially symmetrically about said vertical axis to leave a support pillar of undisturbed material therewithin.

19. The method of claim 12 wherein said stem portion from said first location to said second location is substantially straight and substantially horizontal.

20. The method of claim 12 wherein said stem portion from said first location to said second location extends substantially straight along an axis substantially intersecting said vertical axis.

21. The method of claim 20 wherein said annular head portion is spaced from and extends substantially symmetrically about said vertical axis.

22. A method for making a mine configuration in a subsurface stratum, said configuration substantially resembling a lollipop shape when viewed from above and having a stem portion and a substantially annular head portion with said configuration being primarily intended for use as a production drift for the recovery of petroleum from an overlying, oil bearing formation by gravity drainage, said method including the steps of:

(a) forming said stem portion in said subsurface stratum, said stem portion extending from a first location to a second location, (b) forming said annular head portion, said annular head portion extending from said second location substantially about a vertical axis to a third location and on about said vertical axis back to said second location, said annular head portion and said stem portion together making said lollipop shape, (c) completing a substantially vertically extending service well to connect said lollipop shape substantially at said annular head portion to the surface, (d) drilling at least one production well upwardly from said annular head portion to said oil bearing formation, (e) collecting the produced oil from said production well, and (f) pumping said collected oil up said service well to the surface.

23. The method of claim 22 wherein said annular head portion has a floor, step (b) includes the further limitation of inclining the floor of said annular head portion substantially continuously downwardly from said second location to said third location whereby any free liquid between the second and third locations will flow by gravity to said third location, and said method further includes the step of pumping any free liquid at said third location up said service well to the surface.

24. The method of claim 23 wherein step (b) includes the further limitation of inclining the floor of said annular head portion upwardly from said third location back toward said second location whereby said third location is the lowest area in the annular head portion of the lollipop.

25. The method of claim 24 wherein said upward inclination from said third location back toward said second location includes a substantially vertical step up.

26. The method of claim 25 wherein the step up has a bottom and top area, said top area is between said third location back toward said second location, and the floor of said annular head portion substantially from the top area of the step up back toward said second location is inclined downwardly wherein the top area of the step up is the highest area between the third and second locations.

27. The method of claim 23 wherein said downward inclination is about a one percent slope.

28. The method of claim 23 wherein said stem portion has a floor and step (a) includes the further limitation of inclining the floor of said stem portion substantially continuously downwardly from said first location to said second location.

29. The method of claim 28 wherein said downward inclination of steps (a) and (b) is about a one percent slope.

30. The method of claim 22 further including the step of confining air flow through said lollipop shape to one direction along the stem portion to the annular head portion, substantially around the annular head portion, and up the service well to the surface.

31. The method of claim 22 wherein step (b) includes the further limitation of forming said annular head portion about said vertical axis in a series of substantially straight segments whereby said annular head portion assumes a substantially polygonal shape when viewed from above.

32. The method of claim 22 wherein said annular head portion is spaced from and extends substantially symmetrically about said vertical axis.

33. The method of claim 22 wherein said stem portion from said first location to said second location is substantially straight and substantially horizontal.

34. The method of claim 22 wherein said stem portion extends substantially straight along an axis substantially intersecting said vertical axis.

35. The method of claim 34 wherein said annular head portion is spaced from and extends substantially symmetrically about said vertical axis.

36. The method of claim 22 further including the steps of forming a main drift in said subsurface stratum in the general shape of an 8 when viewed from above and forming at least two lollipop-shaped production drifts extending therefrom by repeating steps (a)–(f) at at least two locations along said main drift.

37. The method of claim 36 wherein the stem portion of at least one of the lollipop production drifts extends outwardly from said 8-shaped main drift and the stem portion of at least another of said lollipop production drifts extends inwardly from one of the loops of said 8-shaped main drift.

38. The method of claim 22 further including the steps of drilling a plurality of production wells upwardly from said annular head portion and said stem portion to said oil bearing formation, collecting the produced oil from said production wells, and pumping said collected oil up said service well to the surface.

39. The method of claim 22 wherein step (c) includes the further limitation of completing said service well to connect said lollipop shape at a site along said annular head portion to the surface.

40. The method of claim 39 wherein said service well site along said annular head portion is adjacent said stem portion.

41. The method of claim 40 wherein said annular head portion extends from said third location back toward said second location in a radial direction about said vertical axis and said service well site is between said third and second locations in said radial direction.

42. The method of claim 22 wherein step (e) includes the further limitation of collecting the produced oil from said production well within said annular head portion.

43. The method of claim 22 further including the limitation of drilling the service well downwardly from the surface to the subsurface stratum and said method includes the further step of locating said service well within said subsurface stratum before beginning step (b) wherein said locating step aides in orienting said annular head portion relative to the service well.

44. The method of claim 22 wherein the subsurface stratum about said vertical axis within said annular head portion is undisturbed material forming a support pillar.

45. A mine configuration in a subsurface stratum primarily intended for use as a production drift for the recovery of petroleum from an overlying, oil bearing formation by gravity drainage, said mine confugration substantially resembling a lollipop shape when viewed from above and having a stem portion and a substantially annular head portion, said mine configuration including:

said stem portion, said stem portion extending in said subsurface stratum from a first location to a second location;

said annular head portion, said annular head portion extending from said second location substantially about a vertical axis to a third location and on about said vertical axis back to said second location, said annular head portion and said stem portion together forming said lollipop shape, at least one service well extending upwardly from said lollipip shape substantially at said annular head portion to the surface, at least one production well extending upwardly from said annular head portion to said oil bearing information, means for collecting the produced oil from said production well, means for pumping said collected oil up said service well to the surface, and wherein said annular head portion includes a floor substantially continuously inclined downwardly from said second location in a radial direction about said vertical axis to said third location whereby any free liquid between said second and third locations will flow by gravity in said radial direction to said third location and said configuration further includes means for pumping any free liquid at said third location up said service well to the surface.

46. The configuration of claim 45 wherein the floor of said annular head portion further extends in said radial direction upwardly from said third location in said radial direction toward said second location whereby said third location is the lowest area in the annular head portion.

47. The configuration of claim 46 wherein said upward inclination from said third location in said radial direction toward said second location includes a substantially vertical step up.

48. The configuration of claim 47 wherein said step up has a bottom and top area, said top area is between said third and second locations in said radial direction, and the floor of said annular head portion substantially from the top area of the step up back toward said second location in said radial direction extends downwardly wherein the top area of the step up is the highest area between the third and second location in said radial direction.

49. The configuration of claim 45 wherein said downward inclination is about one percent slope.

50. The configuration of claim 45 wherein said stem portion includes a floor substantially continuously inclined downwardly from said first location to said second location.

51. The configuration of claim 50 wherein said downward inclination of the floor of said stem portion and the floor of said annular head portion from said second to said third location in said radial direction is about a one percent slope.

52. The configuration of claim 45 wherein said annular head portion has a series of substantially straight segments whereby said annular head portion assumes a substantially polygonal shape when viewed from above.

53. A mine configuration in a subsurface stratum primarily intended for use as a production drift for the recovery of petroleum from an overlying, oil bearing formation by gravity drainage, said mine confuguration substantially resembling a lollipip shape when viewed from above and having a stem portion and a substantially annular head portion, said mine configuration including:

said stem portion, said stem portion extending in said subsurface stratum from a first location to a second location, said annular head portion, said annular head portion extending from said second location substantially about a vertical axis to a third location and on about said vertical axis back to said second location, said annular head portion and said stem portion together forming said lollipip shape, and said annular head portion being spaced from and extending substantially symmetrically about said vertical axis, at least one service well extending upwardly from said lollipip shape substantially at said annular head portion to the surface, at least one production well extending upwardly from said annular head portion to said oil bearing formation, means for collecting the produced oil from said production well, and means for pumping said collected oil up said service well to the surface.

54. The configuration of claim 53 further including means for confining air flow through said lollipop shape to one direction along the stem portion to the annular head portion, substantially around the annular head portion and up the service well to the surface.

55. The configuration of claim 54 wherein said confining means includes battice means for substantially preventing any air flow from said second location toward said third location in a first radial direction about said vertical axis whereby the air flow substantially around said annular head portion is in a radial direction opposite to said first radial direction.

56. The configuration of claim 53 wherein said stem portion extends substantially straight and substantially horizontally from said first location to said second location.

57. The configuration of claim 53 further including a plurality of production wells extending upwardly from said annular head portion and said stem portion to said oil bearing formation, means for collecting the produced oil from said production wells, and means for pumping said collected oil up said service well to the surface.

58. The configuration of claim 53 wherein said service well extends upwardly from said lollipop shape to the surface from a site along said annular head portion.

59. The configuration of claim 58 wherein said service well site is adjacent said stem portion.

60. A mine configuration in a subsurface stratum primarily intended for use as a production drift for the recovery of petroleum from an overlying, oil bearing formation by gravity drainage, said mine configuration substantially resembling a lollipop shape when viewed from above and having a stem portion and a substantially annular head portion, said mine configuration including:

said stem portion, said stem portion extending in said subsurface stratum from a first location to a second location, said annular head portion, said annular head portion extending from said second location substantially about a vertical axis to a third location and on about said vertical axis back to said second location, said stem portion extending substantially straight along an axis substantially intersecting said vertical axis, and said annular head portion and said stem portion together forming said lollipop shape, at least one service well extending upwardly from said lollipop shape substantially at said annular head portion to the surface, at least one production well extending upwardly from said annular head portion to said oil bearing formation, means for collecting the produced oil from said production well, and means for pumping said collected oil up said service well to the surface.

61. The configuration of claim 60 wherein said annular head portion is spaced from and extends substantially symmetrically about said vertical axis.

62. A mine configuration in a subsurfce stratum primarily intended for use as a production drift for the recovery of petroleum from an overlying, oil bearing formation by gravity drainage, said mine configuration substantially resembling a lollipop shape when viewed from above and having a stem portion and a substantially annular head portion, said mine configuration including:

said stem portion, said stem portion extending in said subsurface stratum from a first location to a second location, said annular head portion, said annular head portion extending from said second location substantially about a vertical axis to a third location and on about said vertical axis back to said second location, said annular head portion and said stem portion together forming said lollipop shape, at least one service well extending upwardly from said lollipop shape substantially at said annular head portion to the surface, at least one production well extending upwardly from said annular head portion to said oil bearing formation, means for collecting the produced oil from said production well, means for pumping said collected oil up said service well to the surface, and further including a main drift in said subsurface stratum in the general shape of an 8 when viewed from above with said stem portion extending therefrom and a second lollipop-shaped production drift substantially identical to the first lollipop-shaped production drift with the stem portion of said second production drift extending from said 8-shaped main drift at a location therealong spaced from the stem portion of the first production draft.

63. The configuration of claim 62 wherein the stem Portion of the first lollipop-shaped production drift extends outwardly from said 8-shaped main drift and the stem portion of the second lollipop-shaped production drift extends inwardly from one of the loops of said 8-shaped main drift.

64. A mine configuration in a subsurface stratum primarily intended for use as a production drift for the recovery of petroleum from an overlying, oil bearing formation by gravity drainage, said mine configuration substantially resembling a lollipop shape when viewed from above and having a stem portion and a substantially annular head portion, said mine configuration including:

said stem portion, said stem portion extending in said subsurface stratum from a first location to a second location, said annular head portion, said annular head portion extending from said second location substantially about a vertical axis to a third location and on about said vertical axis back to said second location, said annular head portion and said stem portion together forming said lollipop shape, at least one service well extending upwardly from said lollipop shape from a site along said annular head portion thereof to the surface, at least one production well extending upwardly from said annular head portion to said oil bearing formation, means for collecting the produced oil from said production well, means for pumping said collected oil up said service well to the surface, and wherein said annular head portion extends from said third location back toward said second location in a radial direction about said vertical axis and said service well site is between said third and second locations in said radial direction.

65. A mine configuration in a subsurface stratum primarily intended for use as a production drift for the recovery of petroleum from an overlying, oil bearing formation by gravity drainage, said mine configuration substantially resembling a lollipip shape when viewed from above and having a stem portion and a substantially annular head portion, said mine configuration including:

said stem portion, said stem portion extending in said subsurface stratum from a first location to a second location, said annular head portion, said annular head portion extending from said second location substantially about a vertical axis to a third location and on about said vertical axis back to said second location, said annular head portion and said stem portion, together forming said lollipop shape, at least one service well extending upwardly from said lollipop shape substantially at said annular head portion to the surface, at least one production well extending upwardly from said annular head portion to said oil bearing formation, means for collecting the produced oil from said production well, said means for collecting the produced oil being in said annular head portion, and means for pumping said collected oil up said service well to the surface.

* * * * *